US007653950B2

(12) United States Patent
Johnson

(10) Patent No.: US 7,653,950 B2
(45) Date of Patent: Feb. 2, 2010

(54) STIFFENING DEVICE FOR APPAREL

(76) Inventor: Katie L. Johnson, 2440 Boehm Acres Rd., Seaside, OR (US) 97138

( * ) Notice: Subject to any disclaimer, the term of this patent is extended or adjusted under 35 U.S.C. 154(b) by 0 days.

(21) Appl. No.: 11/937,603

(22) Filed: Nov. 9, 2007

(65) Prior Publication Data

US 2008/0235845 A1 Oct. 2, 2008

Related U.S. Application Data

(63) Continuation-in-part of application No. 11/870,207, filed on Oct. 10, 2007, now abandoned.

(60) Provisional application No. 60/908,048, filed on Mar. 26, 2007.

(51) Int. Cl.
*A41D 27/06* (2006.01)
*A41D 27/12* (2006.01)

(52) U.S. Cl. ..... 2/232; 2/46; 2/255

(58) Field of Classification Search ..... 2/231, 2/232, 233, 46, 60, 255, 256, 260, 227, 47, 2/61, 244, 258, 52, 57, 132, 134, 302, 336, 2/243.1, 261, 269; 36/70 R, 70 A; 24/41.1, 24/3.1, 7

See application file for complete search history.

(56) References Cited

U.S. PATENT DOCUMENTS

| | | | | | |
|---|---|---|---|---|---|
| 771,021 | A * | 9/1904 | Lux | 2/232 |
| 1,211,472 | A * | 1/1917 | Marcelli | 2/232 |
| 1,381,965 | A * | 6/1921 | Cameron, Jr. | 2/232 |
| 1,411,160 | A * | 3/1922 | Caudle | 2/229 |
| 1,474,190 | A * | 11/1923 | Fox | 2/256 |
| 1,823,949 | A * | 9/1931 | Mcinnis | 2/153 |
| 2,279,663 | A * | 4/1942 | Dillon | 2/123 |
| 2,301,047 | A * | 11/1942 | Hendley | 2/255 |
| 2,483,952 | A * | 10/1949 | Wayworth | 2/232 |
| 2,489,388 | A * | 11/1949 | Rubin | 450/143 |
| 2,574,669 | A * | 11/1951 | Snider | 2/232 |
| 3,357,028 | A * | 12/1967 | Laniado | 2/256 |
| 5,626,267 | A * | 5/1997 | Peruski | 223/84 |
| 6,178,557 | B1 * | 1/2001 | Bel Monte | 2/60 |
| 7,328,460 | B1 * | 2/2008 | Mancini | 2/232 |
| 2005/0028252 | A1 * | 2/2005 | Lockwood | 2/271 |
| 2006/0143768 | A1 | 7/2006 | Lockwood | |
| 2006/0218698 | A1 * | 10/2006 | Toyne | 2/231 |
| 2006/0218699 | A1 * | 10/2006 | Chetelat et al. | 2/256 |
| 2006/0230499 | A1 * | 10/2006 | Davis | 2/255 |
| 2007/0150995 | A1 * | 7/2007 | Luna | 2/53 |
| 2007/0294804 | A1 * | 12/2007 | Pinelli | 2/231 |

* cited by examiner

*Primary Examiner*—Amy B Vanatta
(74) *Attorney, Agent, or Firm*—Peter A. Haas

(57) ABSTRACT

In one embodiment, the present invention contemplates a T-shaped stiffening device to prevent a trouser leg from becoming entangled between the foot and a shoe, particularly and open-back shoe, of a wearer. Accordingly, the device includes a stiffening device having a central stiffening member arranged between two opposing layers, one layer having an exterior face having an adhesive. One method of use includes locating an interior portion of a trouser leg, preferably near the hem-line, where stiffening is desired and arranging the device vertically starting at the hem-line at a rear portion of the interior portion of the trouser leg. Finally, adhering the device to the interior portion of the trouser leg using an adhesive provided on the device.

5 Claims, 5 Drawing Sheets

PRIOR-ART

STIFFENING DEVICE FOR APPAREL

PRIORITY CLAIM

The present application claims benefit under 35 USC Section 119(e) of U.S. Provisional Patent Application Ser. No. 60/908,048 filed on 26 Mar. 2007. The present application is based on and claims priority from this application, the disclosure of which is hereby expressly incorporated herein by reference. Further, the present application is a continuation-in-part of application Ser. No. 11/870,207 filed on 10 Oct. 2007 now abandoned having a common inventor.

BACKGROUND

1. Field of the Invention

The present invention relates to clothing apparel and particularly a leg stiffening device that is particularly suited to attach to existing pant, trouser, or slack legs to enhance wear particularly when wearing an open-back shoe.

2. Description of the Prior art and Background of the Invention

A well-understood technique to appear taller and thinner includes using a shoe with a heel placing the wearer's foot at an angle so the heel of the foot is substantially higher than the ball, wearing a trouser that has a leg length that is longer than the wearer's inseam, and further allowing that trouser-leg to carry over the shoe in an unbroken line. This presents the appearance that the wearer has a relatively long and lean leg, which adds visual stature to the wearer and boosts their self-confidence. However, in so doing, the extended trouser leg can become entangled between the shoe and the wearer's foot, particularly when the wearer is sporting open-back shoes. This presents an unsightly gaff and detracts from the visual affect the wearer was attempting, resulting in embarrassing situations or serving as an impediment to mobility.

One attempt to avoid pant entanglement includes a device described by Lockwood in U.S. Patent Application No. US2006/0143768 published on 6 Jul. 2006. Lockwood describes a garment accessory consisting of a support portion, an adhesive strip and a covering. Although the Lockwood device is preferably rectangular and oriented horizontally, vertical strips, block-shaped strips, circular strips are contemplated. However, the Lockwood device has certain drawbacks and shortcomings. For example, although the Lockwood device can prevent some degree of pant or skirt entanglement at the rear of the garment (rear of heal) between a foot and a shoe, the Lockwood device cannot adequately protect against side entanglement. Further, although it is generally desirable to re-use the garment accessory, the Lockwood device includes only a cover, and no base layer, which would enhance its durability. Further, Lockwood teaches a stiffening device comprising cardboard or paper and remaining a light-weight product. However, such construction will not stand-up to multiple re-use, particularly if the garment accessory inadvertently goes through a wash and dry cycle while affixed.

Thus, there is a need for a device that can be integrated into slacks, trousers and the like that prevents this embarrassing tuck-under of the trouser leg under the foot and atop the shoe. The device, further should adapt to be integrated during the manufacture of the garment. Also, and perhaps more importantly, the device should further adapt to be retrofitted to existing garments so that a wearer can quickly and easily adapt their existing wardrobe. Additionally, such a device should be constructed of robust materials that stand up to multiple washings and include means and structures, and materials that provide a rigid, yet light-weight device that easily adapts to multiple uses on garments and can withstand water during washing and heat during drying, and further, can maintain its integrity and stiffness from such use.

SUMMARY OF THE INVENTION

In one embodiment of the present invention, a device designed and adapted for use on the trouser leg of conventional slacks consists of a self-adhesive panel adapted to couple to the cloth or fabric on the inside portion of a conventional trouser leg.

The device is secured vertically beginning at the hem-line to the inside, center back of the pant leg. The device can be selectively removed prior to laundering.

The device enables a wearer to wear long, leg-lengthening slacks and jeans with the wearer's favorite open-back shoes with confidence. No more unsightly and uncomfortable bunching of fabric between the wearer's heel and the shoe.

In one embodiment the present invention has dimensions of about 4 and ¾ inches long by 1 and ½ inches wide with an adhesive-backed fabric strip. A semi-rigid and about four inch long by about 11/16 inches wide plastic strip (also fabric covered) is affixed to the adhesive side of the fabric strip. The adhesive side is covered by a protective strip of non-stick paper.

After removing the adhesive protective strip from the back of the device—the wearer simply secures the device vertically to the inside bottom of the pant leg starting at the seam of the hem-line. When the device is applied to slacks and jeans, the semi rigid plastic strip keeps the garment fabric straight at the heel area. This prevents the fabric from gathering and bunching between the wearer's heel and the open back shoe.

Another possible adhesive back includes an iron-on transfer adhesive.

DRAWING

DESCRIPTION OF THE INVENTION

Possible embodiments will now be described with reference to the drawings and those skilled in the art will understand that alternative configurations and combinations of components may be substituted without subtracting from the invention. Also, in some figures certain components are omitted to more clearly illustrate the invention.

The present invention, illustrated by exemplary embodiments in FIGS. 1, 2, 3, 4, 6, and 7 overcomes the problems and limitations known in the prior art.

Figure 5:
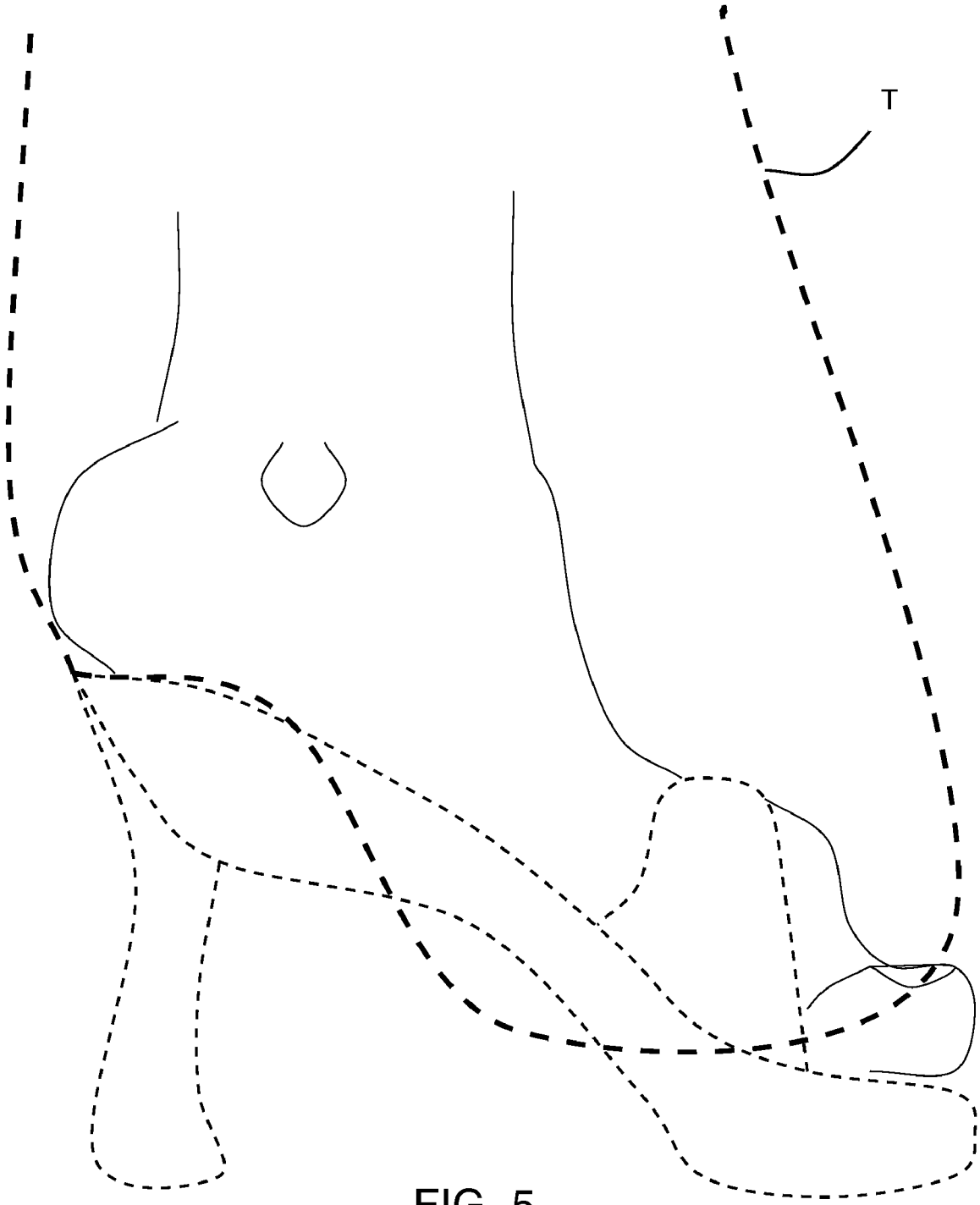
FIG. 5 is a side view of the prior art problem and consists a cross-section of a wearer's trouser leg and shoe.

One particular problem of the prior art, illustrated in FIG. 5 for example, occurs when conventional jeans, trousers T, or other slacks are worn with an open-back shoe S, particularly when that shoe is also a high-heel variety; however, this problems occurs equally when the shoe is a flat bottomed sandal, also. The problem with conventional jeans, trousers and the like is that the lower portion of the pant leg T, near the hem-line, becomes caught under the foot F and atop the shoe S when walking or during otherwise normal use of the shoe.

The accompanying figures illustrate a preferred embodiment of the present invention. For convenience, the corners of the stiffening device are shown as square. However, rounded or angled corners work equally well and should be considered as part of the spirit and scope of the present invention.

The present invention readily adapts for use with existing conventional jeans, trousers, and the like and remedies this prior art problem. The device 10 of the present invention stiffens the lower leg portion of the jeans or trousers and simply adheres to the inside portion of the rear of the trouser leg near the hem-line and arranges itself vertically, horizontally, or both therefrom. In one embodiment, as FIGS. 1, 2, 3, and 6 illustrate, the present invention comprises a stiffening device 10 for a garment consisting of a stiffening member 12 positioned between two opposing layers, a base layer 16 and cover layer 14. The overall dimensions of the opposing base and cover layers are approximately the same for length and width and are oversized in relation to the length and width of the stiffening member 12. Either the base layer or the cover layer 14 or both, on a portion of its respective interior face includes an adhesive element, such as a pressure adhesive that couples the two opposing layers together and sandwiches the member 12 in between the two layers 14 and 16. In other embodiments the pressure adhesive could easily be replaced by a heat-transfer adhesive or, alternatively, could be mechanically coupled together by sewing or stitching the two opposing layers together.

In addition, an exterior face of the base layer 16 includes an adhesive 18 protected by a release liner (not shown in the figures). The adhesive 18 enables a wearer of a garment to selectively locate the appropriate position on the garment and, using an iron for a heat transfer adhesive or pressure for a pressure adhesive, simply place and stick or couple the device 10 to the trouser leg.

Figure 1:
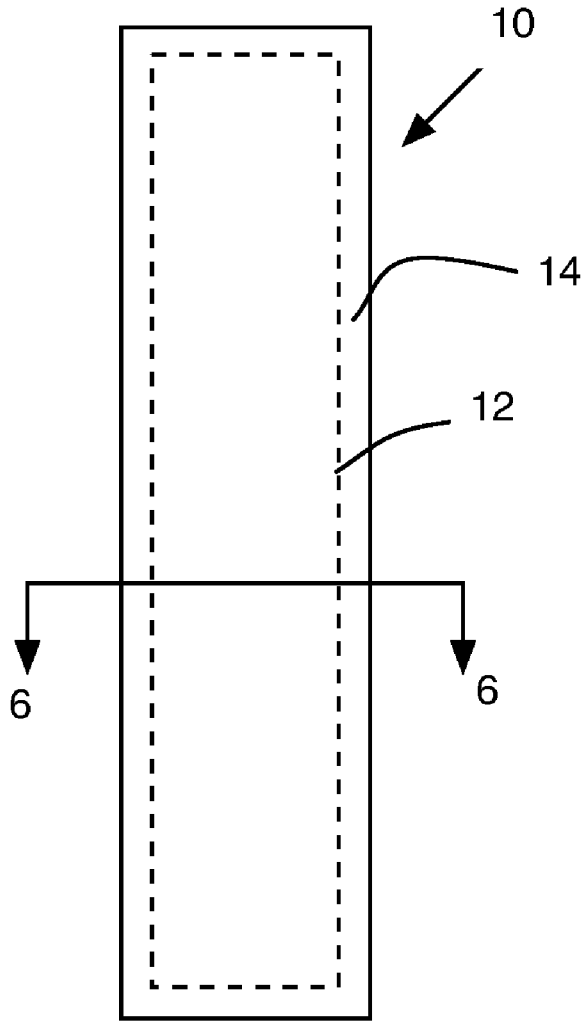
FIG. 1 is a top view of one embodiment according to the present invention.
Figure 6:
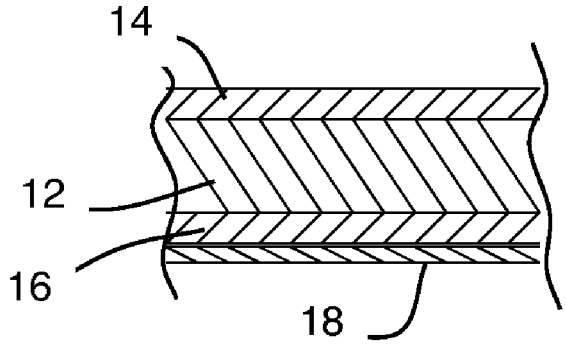
FIG. 6 is a partial cross sectional view along line 6-6 of FIG. 1.
Figure 2:
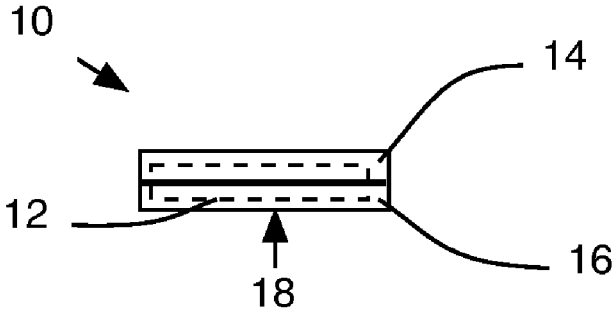
FIG. 2 is a front-end view of the embodiment of FIG. 1.
Figure 3:
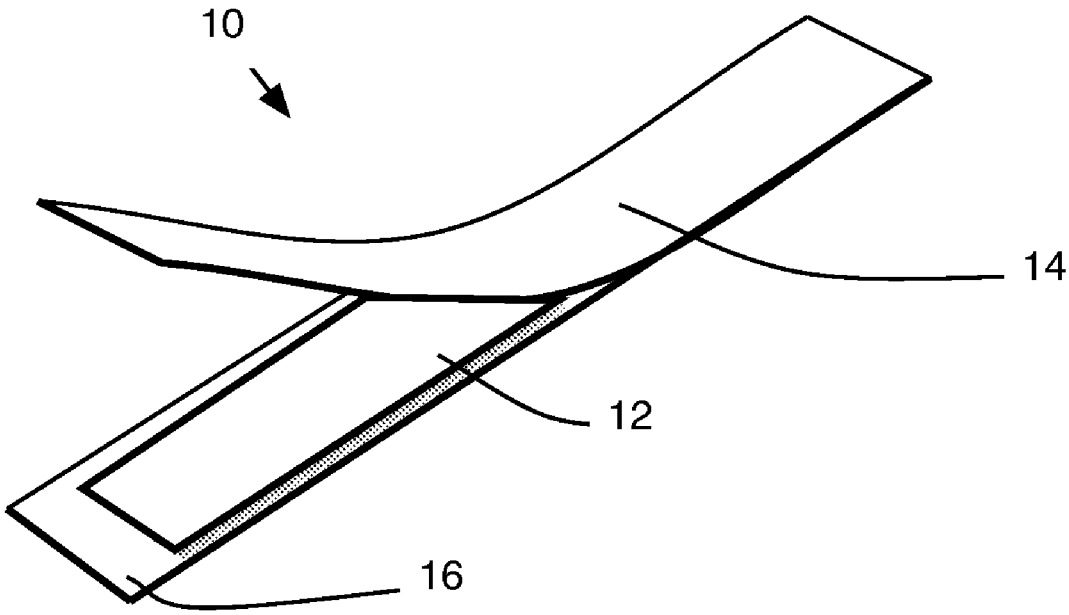
FIG. 3 is an offset frontal view illustrating a possible layer-type construction of one embodiment according to the present invention.
Figure 7:
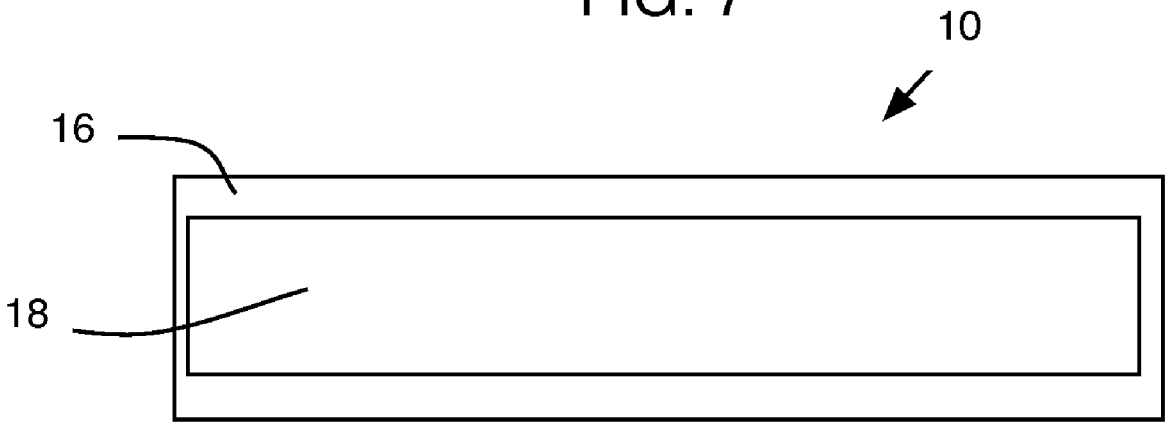
FIG. 7 is a bottom view of the embodiment of FIG. 1.
Figure 4:
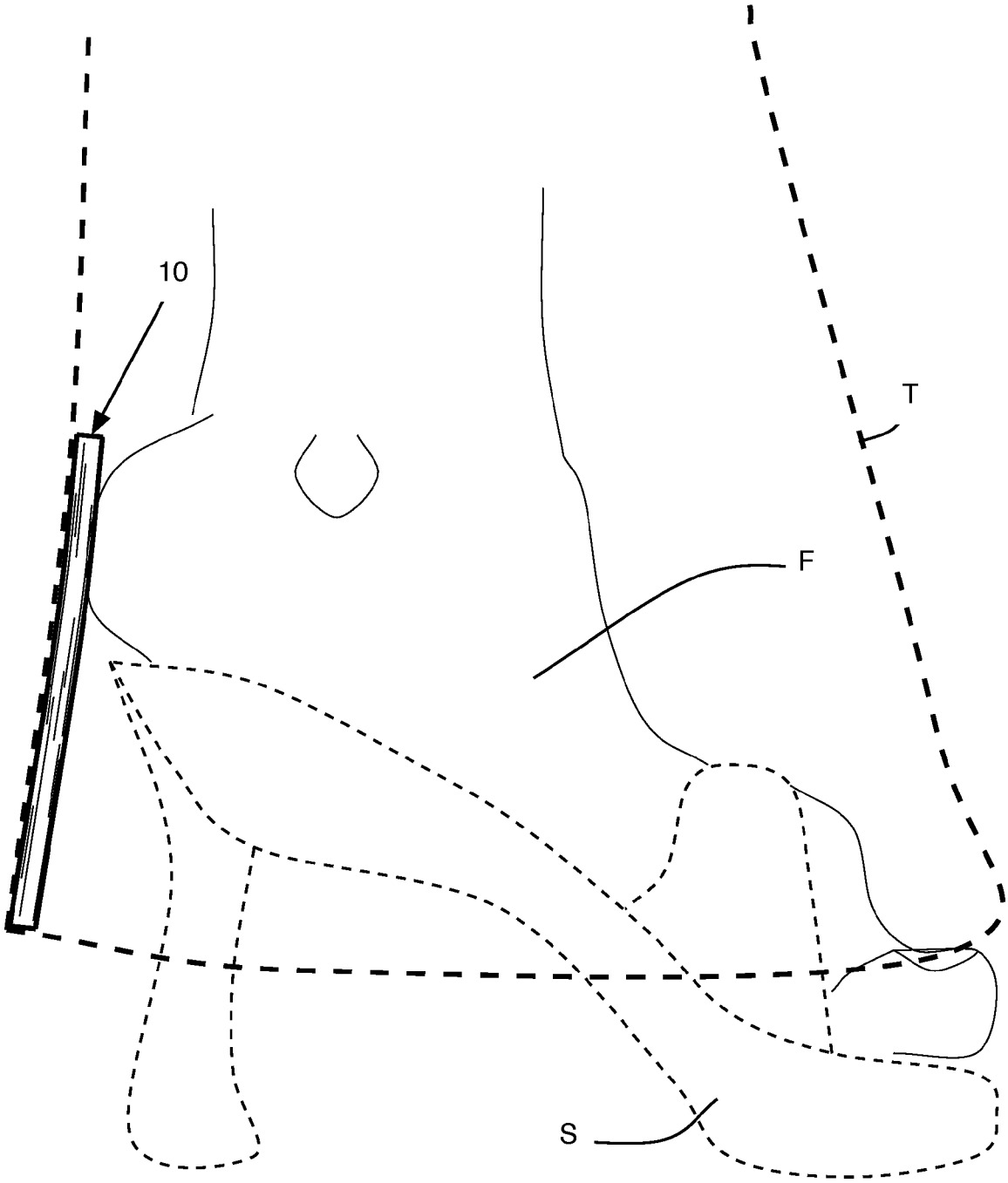
FIG. 4 is a side view of the embodiment of FIG. 1 illustrated in one possible environment of use consisting of a cross-section of a wearer's trouser leg and shoe.

For example, FIG. 4 shows an environment of use where the device 10 according to one embodiment of the present invention couples to the inside back lower trouser leg T of the wearing. This affords the garment with additional rigidity to hang freely and not become entangled under the foot F and atop the shoe S of the wearer.

In a preferred embodiment, the device 10 further includes an adhesive element 18 coupled to an exterior face of the base layer to facilitate coupling of the device to the garment.

In a preferred embodiment, the device 10 also includes a means for coupling the base layer 16 to the cover layer 14, this means comprises an internal adhesive layer arranged on an interior face of either the base layer, the cover layer or both. Alternatively, a mechanical coupling means including sewing or stitching will work equally well.

One method of using the present invention includes: providing a stiffening device 10 having a central stiffening member arranged between two opposing layers, one layer having an exterior face having an adhesive; locating an interior portion of the garment where stiffening is desired; adhering the device to the garment.

Additionally, a second method includes using a stiffening device 10 to prevent a trouser leg from becoming entangled between the foot and a shoe, particularly and open-back shoe, of a wearer, the method comprises: providing a stiffening device having a central stiffening member arranged between two opposing layers, one layer having an exterior face having an adhesive; locating an interior portion of the trouser leg, preferably near the hem line, where stiffening is desired; arranging the device vertically starting at the hem-line at a rear portion of the interior portion of the trouser leg; adhering the device to the interior portion of the trouser leg.

In another method according to a preferred embodiment of the present invention, a stiffening device is incorporated into a garment, such as a trouser leg, during the manufacturing process of the garment. As such, the stiffening member is coupled to the lower portion of a trouser leg near the hem-line. The stiffening member is be adhered using any number of garment adhesives generally understood in this art, or mechanically fastened using sewing, rivets, hook-and-loop fastener or other known means.

In one preferred embodiment, it is desired that the stiffening member be removable from the garment, as such, the stiffening member includes at least one layer that facilitates attaching or coupling the stiffening member to the interior portion of the garment.

In a preferred embodiment, the stiffening device of the present invention adapts to retrofit existing garments and can easily be installed by the consumer, distributor, or manufacturer.

In a preferred embodiment, the stiffening device is releasably coupled to a garment. In yet another preferred embodiment, the stiffening device permanently couples to, or is integral to the garment.

In a preferred embodiment the stiffening device arranges horizontally near the distal end of a trouser leg.

Figure 8:
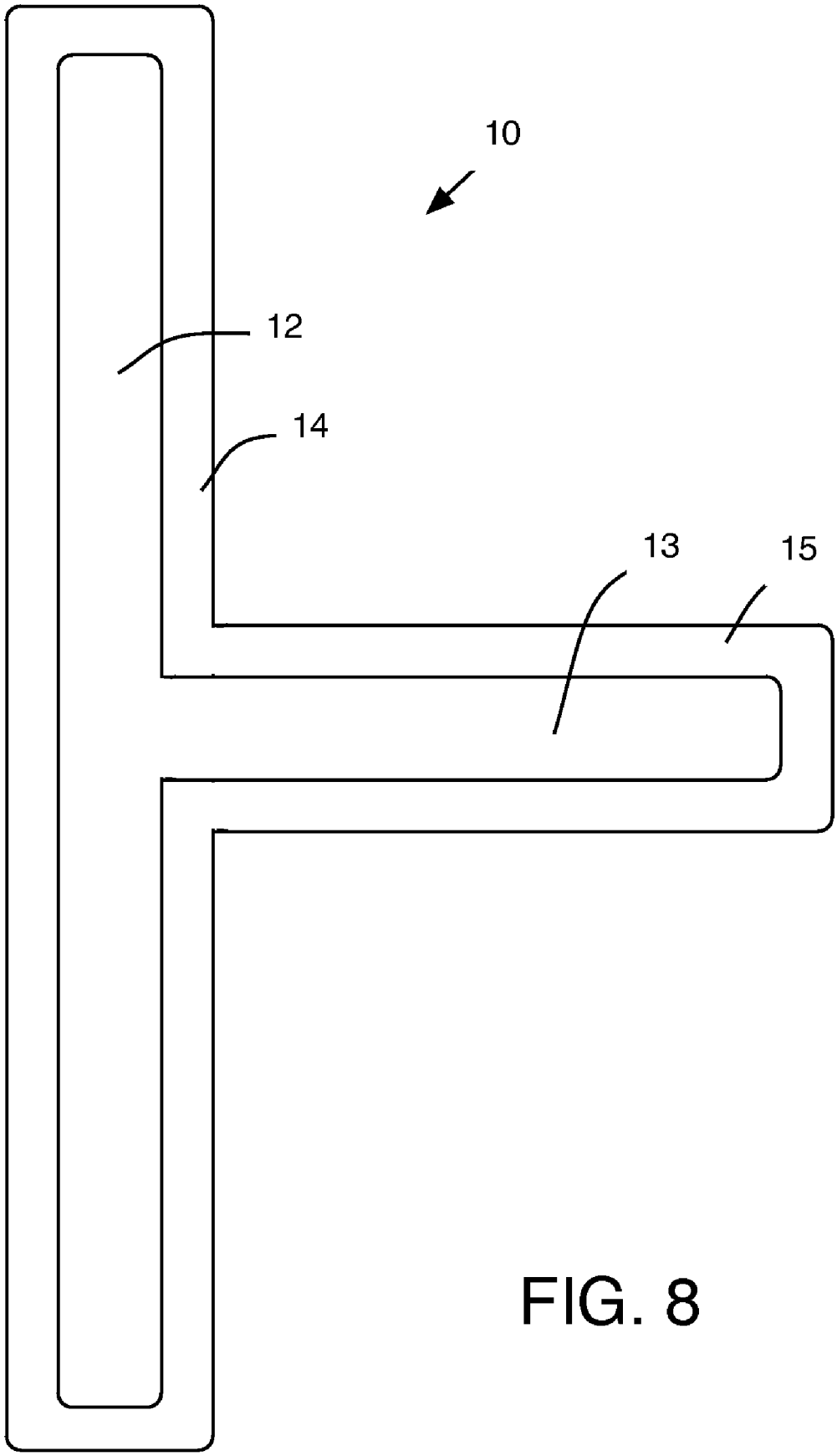
FIG. 8 is a top view of another preferred embodiment of the present invention.

In a preferred embodiment, a stiffening device comprises a generally T-shaped structure consisting of a horizontal stiffening member and a vertical stiffening member. FIG. 8 shows this contemplated device (with the cover-layer removed) including a T-shaped stiffening device 10 consisting of a vertical member arranged generally perpendicular to a horizontal member. Accordingly, the vertical member 15 includes a structural stiffening member 13 that couples or is integrally formed with the horizontal member 12. Although not shown in FIG. 8, the T-shaped stiffening device consists of a cover layer and a base layer that sandwich an intermediate structural or stiffening device, also generally T-shaped. The device of FIG. 8 could consist of two horizontal members and one vertical member all coupled together, or formed as one T-shaped device, or three rectangular device can be arranged in a T-shape and placed directly on the garment.

One preferred T-shaped stiffening device includes a horizontal member measuring approximately about 11-inches in length by 1 and ½-inches in width. A horizontal member measuring approximately about 4 and ¾ inches in length by about 1 and ½-inches in width joins, couples, or is integrally arranges generally perpendicularly with the horizontal member at about its midsection. Both the horizontal member and the vertical member further include a base layer and a cover layer arranged to sandwich a central stiffening member.

One possible material for both the base layer and the cover layer includes nylon, such as the nylon material commonly used as a patch fabric for many apparel items and recreational items such as tents, beach-balls and the like. As commonly used, such patches include either a pressure-sensitive adhesive or a heat sensitive adhesive designed for an iron transfer. One possible cover and base layer material includes a nylon patch available from Prym Consumer USA Inc., item number 55206A available at www.dritz.com. A possible material for the stiffening member includes a heavy-duty template plastic as is commonly used in the hobby or recreational sewing or quilting arts such as item number 3115 sold by Dritz Quilting and available from Prym Consumer USA Inc.

Although the invention has been particularly shown and described with reference to certain embodiments, it will be understood by those skilled in the art that various changes in form and detail may be made without departing from the spirit and scope of the invention.

I claim:

1. A stiffening device for the inside portion of a clothing garment, specifically a trouser leg, the device comprising:

a horizontal stiffening member and a vertical stiffening member arranged generally perpendicular to the horizontal stiffening member to form a generally T-shaped stiffening member, the T-shaped stiffening member comprising a heavy-duty plastic and being arranged between two opposing layers comprising a base layer and a cover layer;

a first adhesive layer for attaching an interior portion of the base layer to a facing and oppositely disposed interior face of the cover layer; and a second adhesive layer coupled to an exterior portion of the base layer, the second adhesive layer adapted to releasably couple to the trouser leg.

2. The device of claim 1 wherein the first adhesive layer comprises any combination of a pressure adhesive, a self-adhesive, or a heat-activated adhesive.

3. The device of claim 1 wherein the base and cover layer comprise a nylon fabric.

4. A stiffening device for the inside portion of a clothing garment, specifically a trouser leg, the device comprising:

a horizontal stiffening member and a vertical stiffening member arranged generally perpendicular to the horizontal stiffening member to form a generally T-shaped stiffening member, the T-shaped stiffening member comprising a heavy-duty plastic and being arranged between two opposing layers comprising a base layer and a cover layer;

a thread member mechanically interwoven through the base and cover layer to encapsulate at least a portion of the T-shaped stiffening member;

and a first adhesive layer coupled to an exterior portion of the base layer, the first adhesive layer adapted to releasably couple to the trouser leg.

5. The device of claim 4 further comprising:

a second adhesive layer for attaching an interior portion of the base layer to a facing and oppositely disposed interior face of the cover layer.

* * * * *